United States Patent [19]

Rushbrook et al.

[11] Patent Number: 4,821,609

[45] Date of Patent: Apr. 18, 1989

[54] SHINGLE CUTTING TOOL

[75] Inventors: Stanley E. Rushbrook, Germantown; Tommy M. Scott, Adamstown, both of Md.

[73] Assignee: Stanley E. Rushbrook, Gaithersburg, Md.

[21] Appl. No.: 87,222

[22] Filed: Aug. 20, 1987

[51] Int. Cl.[4] ..... B25B 00/00

[52] U.S. Cl. ..... 81/45; 30/172; 30/314

[58] Field of Search ..... 81/45, 46, 177.8, 177.6; 30/169, 172, 314, 317

[56] References Cited

U.S. PATENT DOCUMENTS

| | | | |
|---|---|---|---|
| 40,163 | 10/1863 | Fitch . | |
| 334,724 | 1/1886 | Ruekstuhl . | |
| 541,963 | 7/1895 | Carpenter . | |
| 1,516,789 | 11/1924 | Rassner | 30/314 |
| 1,790,014 | 1/1931 | Mikitta | 30/314 |
| 2,106,055 | 1/1938 | Long | 30/172 |
| 3,233,643 | 8/1963 | Reuterfors | 145/3 |
| 3,836,119 | 9/1974 | Saucier | 30/169 |
| 3,918,158 | 11/1975 | Debski | 30/314 |
| 4,477,972 | 10/1984 | Testa | 30/172 |

*Primary Examiner*—James G. Smith

*Attorney, Agent, or Firm*—Laurence R. Brown; Alfred J. Mangels

[57] ABSTRACT

A shingle cutting tool for cutting portions of shingles from an existing shingled roof. The tool is adapted for pushing or pulling action while the user is in an upright position, and includes one or more V-shaped cutting notches formed in the end of a generally rectangular steel plate, the cutting notch forming a lifting lip that is used to pry a shingle upwardly into a position so that it can be cut. The tool is pushed along or pulled along the roof surface so that the respective shingle tabs enter the V-shaped cutting notch to permit the tabs to be severed from the existing roof.

11 Claims, 2 Drawing Sheets

SHINGLE CUTTING TOOL

BACKGROUND OF THE INVENTION

1. Field of the Invention

This invention relates to cutting tools for cutting sheet materials, and more particularly to a cutting tool for quickly and easily cutting roofing shingles that have been installed on a roof.

2. Description of the Related Art

Asphalt shingles are the most prevalent roofing material used on homes, garages, and other structures having gabled roofs. After exposure to the elements for a period of years, the time being dependent upon the climatic conditions to which the roof has been exposed, it is necessary that a new roof be applied because of cracking and embrittlement and curling of the shingles. Although a replacement roof can be applied directly over the old roof, it is common to remove at least part of the old roof in order to reduce the weight of the roofing material that must be supported by the roof's structure and leave a flat surface for the new shingles to lay on. Oftentimes the partial removal of an existing roof involves severing the tab portions of the shingles from the roof and discarding them, and then applying the new roofing shingles directly over the remaining parts of the old roofing shingles.

The removal of the tab portions of old shingles on a roof has most often been performed with a small, hand held cutting tool, such as a linoleum cutter having a convexly curved cutting blade. However, the cutting operation using a hand held cutter is a time-consuming and tiring operation because it requires that the roofer kneel on the roof and draw the linoleum knife across the old shingles, using only one arm to exert downward pressure on the hand-held linoleum cutter in order to cut through the old roofing material.

Accordingly, it is an object of the present invention to provide a shingle cutting tool that permits more rapid cutting of shingle tabs from an existing shingled roof.

It is another object of the present invention to provide a shingle cutting tool that can be quickly and conveniently drawn or pushed across the roofing surface to rapidly cut through the existing roofing material.

It is a still further object of the present invention to provide a shingle cutting tool that can be used to perform the cutting operation while the roofer is standing, and so that he can either push or pull the device along the roof using both arms as he walks along the roof surface.

SUMMARY OF THE INVENTION

Briefly stated, in accordance with one aspect of the present invention, a shingle cutting tool is provided for cutting roofing shingles while installed on a roof. The cutting tool includes a cutting body and an elongated handle that extends from the cutting body. The cutting body includes a guide surface that is adapted to slide along the surface of a singled roof, and at least one V-shaped cutting notch adjacent the guide surface. The cutting notch has an apex that extends inwardly of the cutting body to define a substantially V-shaped lifting lip with the guide surface. The area between the guide surface and the outer edge of the lifting lip includes a convexly curved surface that provides a movable fulcrum for prying shingles upwardly to separate them from underlying shingles. The handle is connected to and extends from the cutting body to define an acute angle with the guide surface and to permit movement of the cutting body along the surface of a shingled roof while the user is in an upright position to facilitate severing portions of the shingles from the roof.

In accordance with another aspect of the present invention, a shingle cutting tool is provided that includes a plurality of V-shaped cutting notches so that the tool can either be pushed along the roof surface or pulled therealong, to provide greater flexibility in how the tool can be used at different portions of the surface of the roof.

DESCRIPTION OF THE PREFERRED EMBODIMENTS

Figure 1:
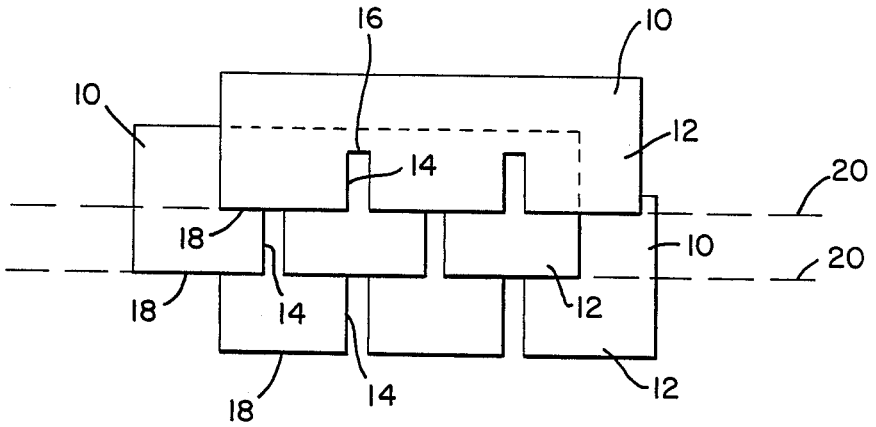
FIG. 1 is a fragmentary top view of a portion of a roof showing a plurality of shingles arranged in overlapping relationship.

Referring now to the drawings, and particularly to FIG. 1 thereof, there is shown a portion of roof on which a plurality of sheets 10 of asphalt shingles have been arranged in staggered and overlapped relationship. Sheets 10 each include a plurality of spaced tabs 12 defined by inwardly extending rectangular notches 14 that each terminate at respective inner edge 16. The sheets are so positioned that each tab overlies a pair of tabs on the underlying sheet, with the lowermost edges 18 of the respective overlapped tabs spaced from each other a predetermined distance. When an old roof has deteriorated to the point where the tab portions of the old shingles have begun to blister, bubble and or curl on their edges, the tab portions of the these shingles are usually removed by cutting the shingles along lines 20 to reduce the dead load on the roofing structure and provide a flat-smooth surface for the new shingles.

Figure 2:
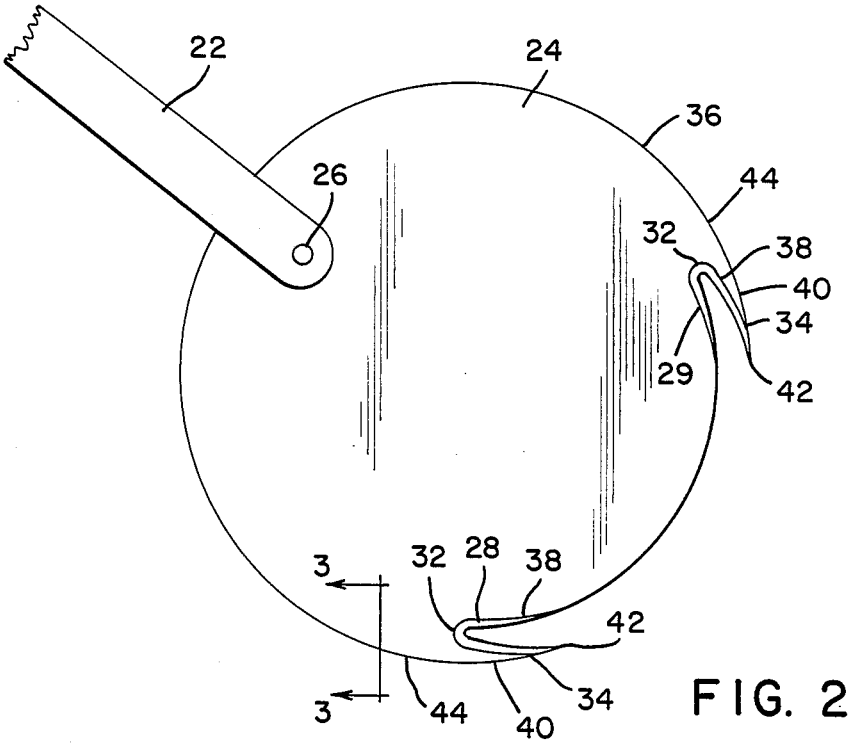
FIG. 2 is a fragmentary side view of a shingle cutting tool in accordance with the present invention.

FIG. 2 illustrates one form of shingle cutting tool in accordance with the present invention. The tool includes an elongated handle 22, only part of which is shown, and the handle is securely and non-pivotably connected at one end to a cutting body 24 by means of a rivet 26, or the like. The handle is of a sufficient length to permit a user of the tool to remain upright when the tool is in use.

Cutting body 24 is in the form of a flat plate, and preferably is made of a hardened steel for reasons that will hereinafter appear. As shown, cutting body 24 is of generally rectangular configuration, and includes a pair of V-shaped cutting notches 28 at the outermost end 30 of the cutting body, relative to handle 22. Cutting notches 28 each have an apex 32 that is positioned inwardly relative to end 30, and the longitudinal axes of the respective notches diverge outwardly in a direction toward handle 22. Each of cutting notches 28 includes sharpened cutting edges on each of the cutting notch surfaces.

The two cutting notches 28, 29 illustrated in FIG. 2 are of different lengths. The uppermost cutting notch 29 has a somewhat shallower depth, with shorter cutting edges, and has a shorter and thicker generally triangular lip 34 defined between the notch and edge 36 of cutting body 24, as compared with the lowermost cutting notch 28. In that regard, cutting notch 29 is preferred for cutting through old roofing shingles that are very brittle and tend to be of a crumbly nature. On the other hand, where the shingles have not deteriorated to the point of excessive brittleness, longer cutting notch 28 is preferred for cutting the shingles.

Figure 3:
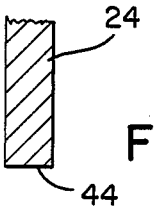
FIG. 3 is a fragmentary cross-sectional view taken along the line 3—3 of FIG. 2.

Each of notches 28, 29 has an outermost surface 38 spaced from an outer edge of the cutting body means to define the respective triangular lifting lips 34. The lifting lip is utilized for getting under a shingle tab to separate it from the underlying tabs, and lift it to permit it to be cut. Preferably, the outermost surfaces of each of lifting lips 34 are convexly curved to permit the outer points 42 of each lifting lip to be pivoted to pry up the portion of the shingle tab that is intended to be cut. A guide surface 44 is provided immediately behind each of curved surfaces 40. Guide surfaces 44 are intended to contact and ride along the surface of the roof when the tool is in use. Furthermore, as shown in FIG. 3, guide surfaces 44 can be flat surfaces defined by edges of cutting body 24.

As earlier noted, cutting body 24 is preferably made from a hardened steel, one reason for which is the necessity for having a metal that can take and hold a sharp cutting edge when exposed to the gritty asphalt roofing shingle materials. Typically, such asphalt shingles include surface particles that are abrasive, and consequently a hardened edge for the cutting surface is required in order to minimize the need for frequent sharpenings. Additionally, to a very large extent, the cutting tool is selfsharpening because of the abrasive particles. Another reason for preferring a hardened steel is to prevent excessive wear of the guide surface, which typically is pushed downwardly against the roof, and is subjected to the abrasive action of the gritty roofing material surface particles.

Figure 4:
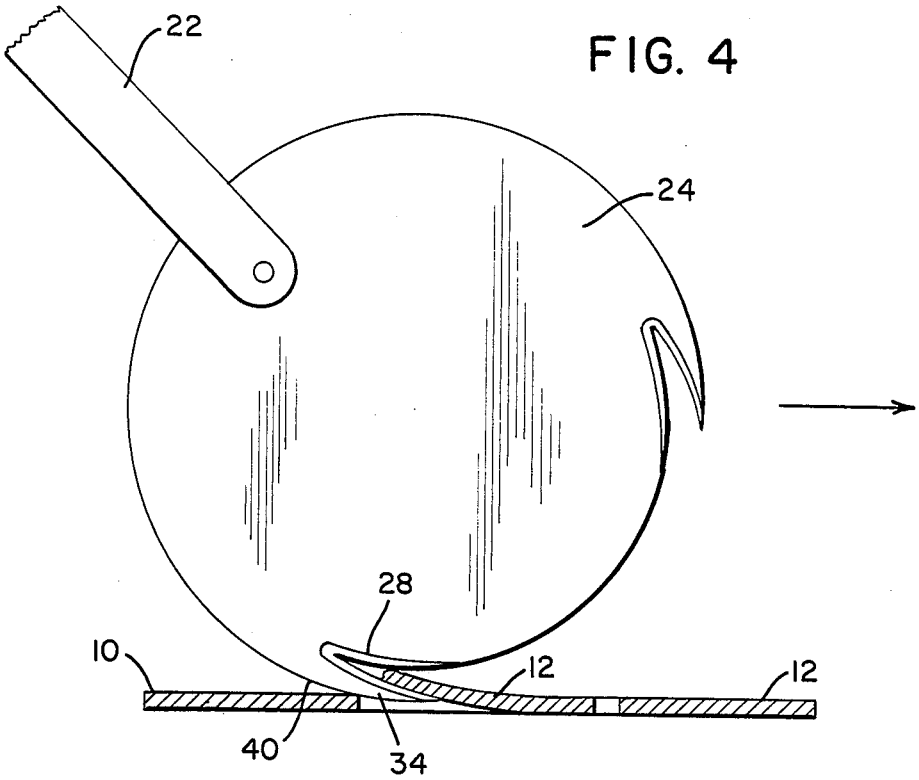
FIG. 4 is a side view of the tool illustrated in FIG. 2, showing the positioning of the tool relative to shingles on an existing roof.

The use of the cutting tool of FIG. 2 is illustrated in FIG. 4. As there shown, the existing roof shingles 10 include a series of spaced tabs 12, and the lifting lip 34 is utilized to pry up tabs 12 in order to initiate the cutting operation. The curved surface 40 adjacent the outer edge of the cutting notch facilitates the prying-up operation, and once the cut is started, the tool is moved in the direction of the arrow while the user merely walks along the roof and presses downwardly on handle 20 to cause the successive tabs of the shingles to enter notch 28 and be cut by the edges of the notch. When a particular line 20 (see FIG. 1) of tabs has been cut, the roofer can merely reverse his direction to cut the next line and then successively cut the tabs of the existing roof in a quick and easy manner.

The V-shaped cutting notches 28, 29 can have an apex angle that ranges from about 10° to about 30° or so, and preferably is within the range of from about 10° to about 20° for rapid and efficient cutting. Additionally, handle 22 has a longitudinal axis that is inclined relative to guide surfaces 44 at an angle of from about 30° to about 60°, in order to permit comfortable operation of the cutting tool. Preferably, however, the angle of the handle relative to the guide surfaces ranges from about 40° to about 50°.

Figure 5:
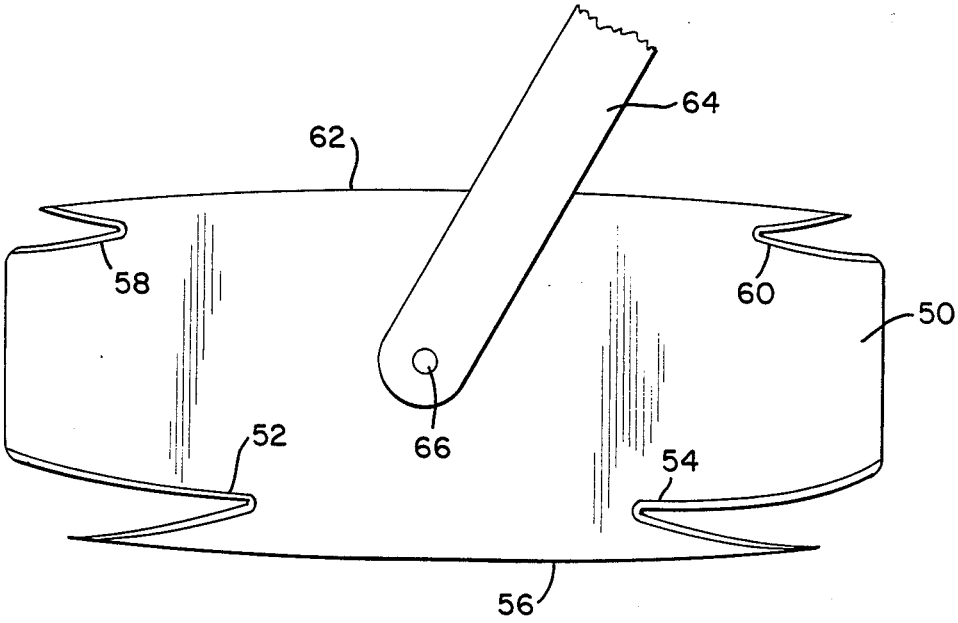
FIG. 5 is a fragmentary side view of another embodiment of a shingle cutting tool in accordance with the present invention.

Another embodiment of the present invention is illustrated in FIG. 5, in which a cutting body 50 is provided in a generally rectangular form, and includes two pairs of opposed, V-shaped cutting notches 52, 54 at the outermost ends of the lowermost surface 56 of cutting body 50, and two pairs of opposed, V-shaped cutting notches 58, 60 at the outermost ends of the upper edge 62 of the rectangular body. The orientation of the cutting notches in opposed relationship as shown in FIG. 5 permits the tool to be used in a pushing direction to cause cutting to take place at notch 52, and, if desired, to be used in a pulling direction by causing the cutting to take place at notch 54. As also apparent from FIG. 5, the provision of multiple cutting notches on each of the upper and lower surfaces of cutting body 50 permits the body to be turned relative to the handle after one set of cutting notches has worn to the point that cutting is rendered more difficult. In that regard, handle 64 can be bolted to the cutting body by bolt 66, or the like, in order to enable the bolt to be loosened to permit the cutting body to be rotated relative to the handle to expose the alternate pair of cutting notches and place them in an operating position. After the cutting body is so rotated, the bolt is securely tightened so that the body and handle are incapable of relative movement. As in the embodiment of FIG. 2, the portions of uppermost surface 62 and lowermost surface 56 adjacent the cutting notches are curved to permit the prying-up operation previously described.

Although particular embodiments of the present invention have been illustrated and described, it will be apparent to those skilled in the art that various changes and modifications can be made without departing from the spirit of the invention. It is therefore intended to encompass within the appended claims all such changes and modifications that fall within the scope of the present invention.

What is claimed is:

1. A shingle cutting tool comprising:

(a) cutting body means including convexly curved guide surface means for permitting rocking movements of the cutting tool relative to a roof surface to pry up roof shingles while the guide surface means is in contact with a roof surface, the guide surface means adapted to slide along the surface of a shingled roof, the cutting body means including at least one V-shaped cutting notch having an apex extending inwardly of the body means and positioned adjacent to the guide surface means to define with the guide surface means a substantially V-shaped lifting lip the lifting lip including a convexly curved outer edge; and (b) handle means defining a handle axis and connected to and extending from the body means to define an acute angle with the guide surface means and to permit movement of the cutting body means along the surface of a shingled roof while the user is in an upright position to sever portions of the shingles from a roof by causing the shingles to enter the cutting notch.

2. A cutting tool in accordance with claim 1 wherein the cutting notch apex angle is from about 10° to about 30°.

3. A cutting tool in accordance with claim 1 wherein the cutting notch apex angle is from about 10° to about 20°.

4. A cutting tool in accordance with claim 1 wherein the handle means includes a longitudinal axis that is inclined relative to the guide surface at an angle of from about 30° to about 60°.

5. A cutting tool in accordance with claim 4 wherein the angle between the handle means and the guide surface is from about 40° to about 50°.

6. A cutting tool in accordance with claim 1 wherein the body means is a flat metallic plate of hardened steel.

7. A cutting tool in accordance with claim 1, wherein the cutting body means includes two V-shaped cutting notches each extending inwardly from an end surface of the cutting body, the end surface being spaced axially outwardly along the handle axis from the connection between the handle means and the cutting body means, the cutting notches positioned on opposite sides of the handle axis and having respective longitudinal axes inclined relative to the handle axis.

8. A cutting tool in accordance with claim 1 wherein the cutting body means includes a pair of V-shaped cutting notches in opposed relationship, the cutting notches having longitudinal axes that converge toward each other in a direction toward the handle axis.

9. A cutting tool in accordance with claim 8 wherein the cutting body includes two pairs of V-shaped cutting notches, one pair adjacent a bottommost edge of the cutting body means, and a second pair adjacent an uppermost edge of the cutting body means.

10. A cutting tool in accordance with claim 9 wherein the cutting body means is pivotable relative to the handle means to permit selective orientation of a pair of V-shaped notches in an operating position.

11. A shingle cutting tool for manual use while the user is in an upright position, the tool comprising: a cutter body in the form of a metallic plate of generally rectangular form, the plate having a pair of V-shaped cutting notches extending inwardly from one side thereof, the cutting notches having longitudinal axes disposed in diverging relationship in an inward direction relative to the cutter body, the cutter body including guide surfaces spaced outwardly from the cutting notches, the cutting notches defining convexly curved lifting lips with said one side of the cutter body for permitting rocking movement of the cutter body relative to a roof surface to pry up roof shingles, the cutting notches having an apex angle of from about 10% to about 25%; and handle means extending from the cutter body and of a length sufficient to permit use of the cutting tool by a person in an upright position, the handle means being oriented relative to the axis of the cutting guide surfaces at an angle of from about 40° to about 50°.

* * * * *